US008454338B2

(12) United States Patent
Yang

(10) Patent No.: US 8,454,338 B2
(45) Date of Patent: Jun. 4, 2013

(54) APPARATUS FOR MANUFACTURING INFILTRATING WATER-PROOF MATERIAL FOR ZIPPER

(76) Inventor: Shih Sheng Yang, Taipei Hsien (TW)

( * ) Notice: Subject to any disclaimer, the term of this patent is extended or adjusted under 35 U.S.C. 154(b) by 1015 days.

(21) Appl. No.: 12/140,290

(22) Filed: Jun. 17, 2008

(65) Prior Publication Data

US 2008/0248146 A1 Oct. 9, 2008

Related U.S. Application Data

(63) Continuation-in-part of application No. 10/986,543, filed on Nov. 12, 2004, now abandoned.

(51) Int. Cl.
*B32B 37/00* (2006.01)
*B05C 1/04* (2006.01)
*B05C 1/08* (2006.01)

(52) U.S. Cl.
USPC ..... 425/117; 425/122; 425/256; 264/275; 264/255; 264/279.1; 118/77

(58) Field of Classification Search
USPC ..... 425/256, 122, 117; 249/117; 118/77; 264/275, 271.1, 279.1, 255
See application file for complete search history.

(56) References Cited

U.S. PATENT DOCUMENTS

| | | | | |
|---|---|---|---|---|
| 2,016,316 | A * | 10/1935 | Collins | 427/284 |
| 2,589,442 | A * | 3/1952 | Siegrist | 249/95 |
| 4,691,373 | A * | 9/1987 | Ausnit | 383/63 |
| 5,529,482 | A * | 6/1996 | Mayerhofer | 425/545 |
| 5,962,040 | A * | 10/1999 | Dais et al. | 425/290 |
| 8,122,687 | B2 * | 2/2012 | Kinigakis et al. | 53/412 |
| 2005/0062197 | A1 * | 3/2005 | Kitayama et al. | 264/255 |
| 2006/0163772 | A1 * | 7/2006 | Lammers et al. | 264/257 |
| 2006/0237868 | A1 * | 10/2006 | Ito | 264/132 |

* cited by examiner

*Primary Examiner* — Joseph S Del Sole
*Assistant Examiner* — Nahida Sultana
(74) *Attorney, Agent, or Firm* — Leong C. Lei

(57) ABSTRACT

An apparatus for manufacturing infiltrating water-proof material for zippers comprising a lower mold and an upper mold, wherein the lower mold is positioned with a positioning recession and a groove, the upper mold is provided with a mold cave on a top thereof and a scraper portion on a bottom edge thereof and adhering to a bottom surface of the positioning recession, whereby the upper mold is assembled to the lower mold into a unitary member in which the upper mold is fitted in the positioning recession, a liquid PU rubber which has been treated with thickening step is poured into the mold cave of the upper mold, and then a zipper tap is moved by transferring rollers to the positioning recession to provide a water-proof film therefor.

1 Claim, 6 Drawing Sheets

APPARATUS FOR MANUFACTURING INFILTRATING WATER-PROOF MATERIAL FOR ZIPPER

CROSS-REFERENCE

This is a continuation-in-part of the patent application Ser. No. 10/986,543 filed Nov. 12, 2004, now abandoned.

BACKGROUND OF THE INVENTION (a) Technical Field of the Invention

The present invention relates to an apparatus for infiltrating water-proof material for zippers, such that a common zipper will become water-proof due to the infiltration of the impermeable rubber material into the zipper tapes. The present invention is applicable to processing water-proof zippers and water-proof fabrics or the like.

(b) Description of the Prior Art

In the method for manufacturing water-proof zippers of the prior art as disclosed in U.S. Pat. No. 6,105,214, a water-proof layer is attached to the surface of the zipper tapes via adhesive or heat press. The zipper is composed of a pair of opposed tapes, which are combined or separated by a moving zipper tab. Therefore, after application of the water-proof layer of to the surface of the zipper via adhesive or heat press, an additional process for cutting the water-proof layer to separate the tapes is required, rendering the manufacture process relatively complicated, the manufacture speed slower, and the manufacture cost higher.

As the water-proof layer for a conventional zipper can only adhered to the surface of the zipper tapes, it cannot firmly combine with the zipper tapes. Therefore, after being used for a short period of time, the water-proof layer would easily detach from the zipper tapes due to friction, causing the water-proof effect apparently reduced.

In view of the disadvantages existing in the manufacture of the water-proof zippers of the prior art, the inventor has researched and developed the present invention.

SUMMARY OF THE INVENTION

The primary purpose of the present invention is to provide an apparatus for manufacturing infiltrating water-proof material for zippers, such that after the impermeable material has solidified, it can infiltrate into the zipper tapes and form a water-proof layer with the zipper tape fabric to obtain a super water-proof effect.

The secondary object of the invention is to provide an apparatus for manufacturing infiltrating water-proof material for zippers, which can efficiently shorten the manufacture process, since there is no need to cut the zipper to separate the zipper tapes. Accordingly, the manufacture cost can be reduced.

A further object of the invention is to provide an apparatus for infiltrating water-proof material for zippers, which can efficiently lengthen the use life of the water-proof zipper.

To obtain the above objects, the apparatus for manufacturing infiltrating water-proof material for zippers according to the invention includes the following manufacturing steps:

thickening—adding thickening agents and hardening agents into a water-proof liquid PU rubber, and mixing the above materials to present an appropriate viscosity;

pouring—combining an upper mold with a lower mold, and then pouring the thicken water-proof liquid PU rubber into the mold cave of the upper mold; and applying the water-proof layer—pulling the zipper through the underside of the mold cave, such that the water-proof liquid PU rubber will infiltrate into the zipper tape fabric; scrapping away the surplus liquid PU rubber by a scrapper portion at the lower edge of the upper mold; meanwhile, the liquid PU rubber applied onto the zipper tapes will further infiltrate into the tape fabric and form a water-proof layer with the zipper tapes.

By way of the above steps, a water-proof zipper, which has long use life, can be accomplished. Besides, the manufacture procedure can be shortened, and the manufacture cost can be reduced.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
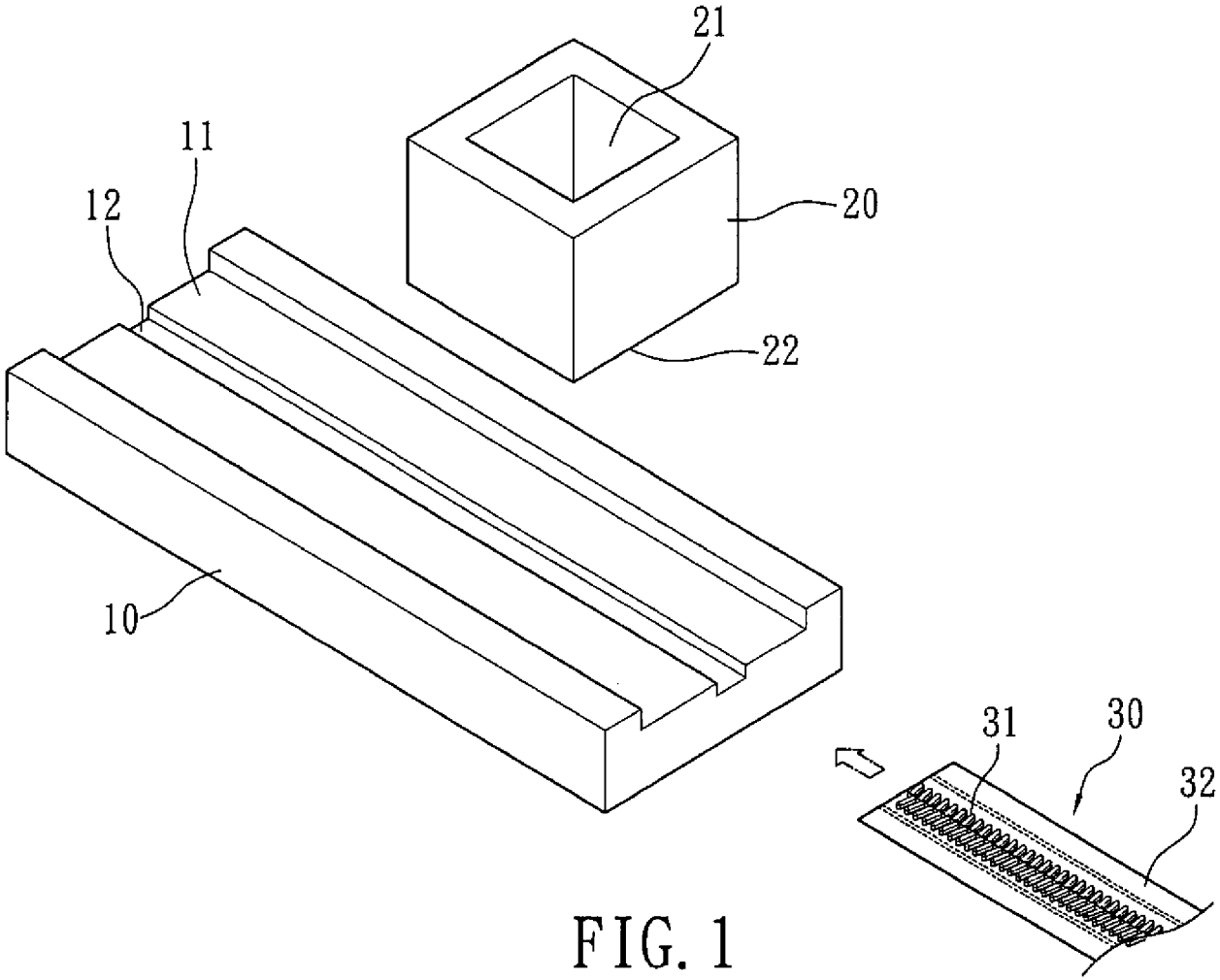
FIG. 1 is an exploded view of the upper mold, the lower mold and the zipper of the present invention.
Figure 2:
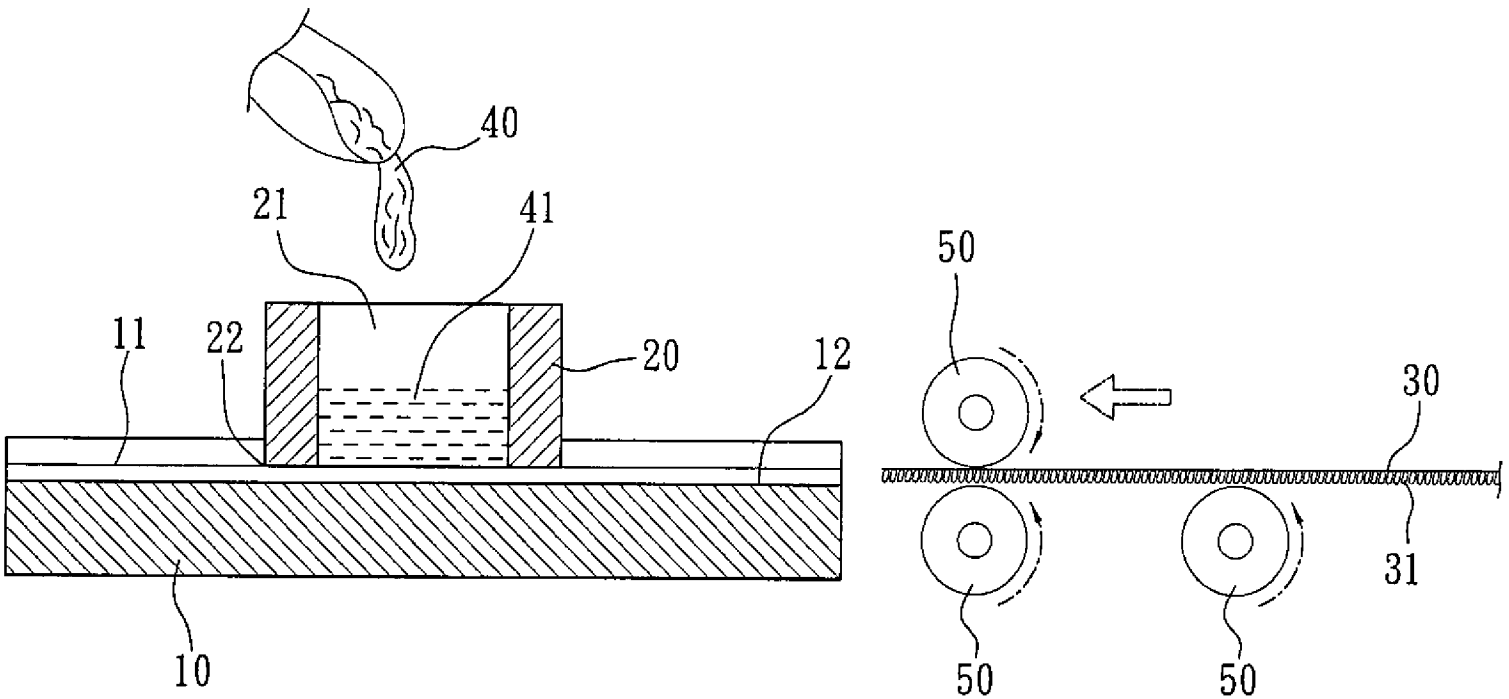
FIG. 2 shows the manufacture process according to the invention, wherein the zipper is going into the mold cave.
Figure 3:
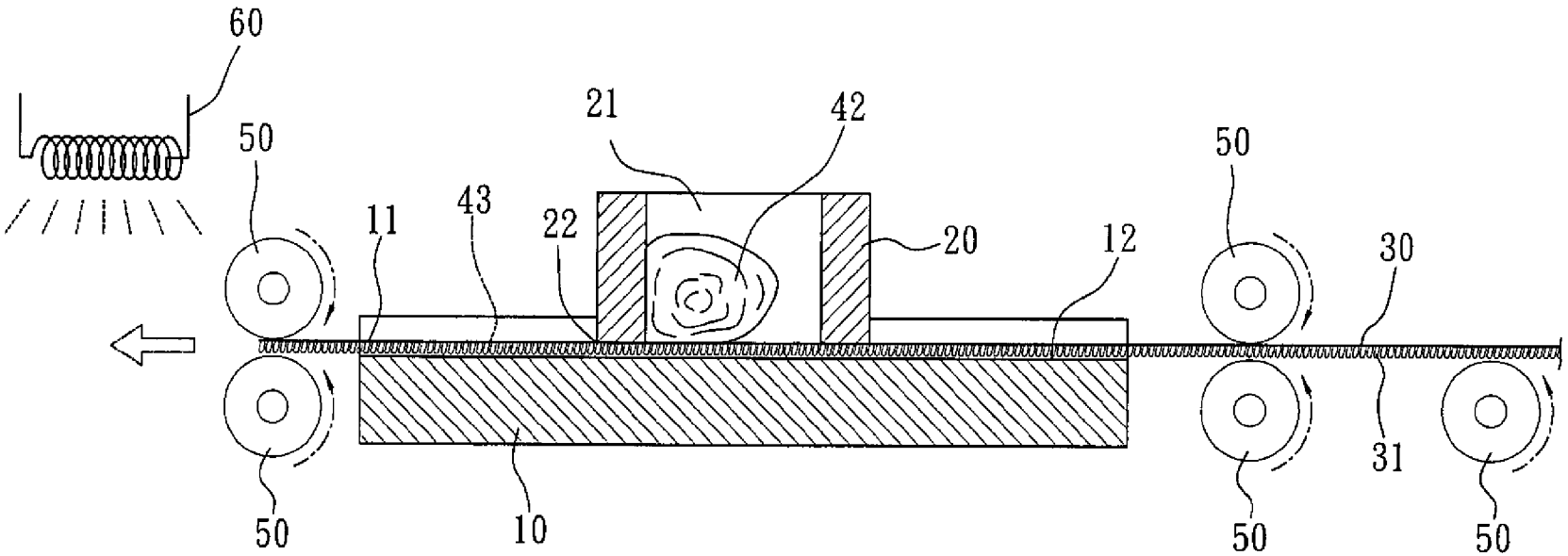
FIG. 3 shows the manufacture process according to the invention, wherein the zipper has gone into the mold cave for infiltrating a impermeable liquid material into the fabric of the zipper tapes, and zipper surface is applied with a layer of water-proof rubber material.

Referring to FIGS. 1 to 3, the apparatus for manufacturing infiltrating water-proof material for zippers according to the present invention comprises the process of thickening, pouring and the applying the water-proof layer, thereby lengthening the use life of the water-proof zipper, and relatively reducing the manufacture procedure and cost.

FIGS. 1 and 2 show a preferred embodiment of the invention, which includes a lower mold 10 and an upper mold 20. The lower mold 10 is provided with a positioning recession 11 and a groove 12, which is most preferably arranged at the center of the positioning recession 11, such that when a zipper 30 is born by and sliding on the positioning recession 11, the groove 12 can receive the zipper teeth 31, thus allowing the zipper tapes 32 stay flat on the positioning recession 11. The upper mold 20 is provided with a mold cave 21 on the top, and a scraper portion 22 on the bottom edge adhering to the bottom surface of the positioning recession 11.

As shown in FIGS. 2 and 3, the invention relates to a method for processing a normal zipper 30 into a water-proof zipper, including the steps of combining the lower mold 10 integrally with the upper mold 20, processing the zipper 30 via a conveyor roller 50 forwardly such that the zipper 30 will go into the positioning recession 11 with the zipper teeth 31 filled into the groove 12 of the lower mold 10. Accordingly, the zipper 30 is moving under the upper mold 20.

Following is the steps of—

Thickening—A liquid PU rubber water-proof material 40 is added with a thickening agent and a hardening agent and mixed together to form a liquid PU rubber 41 of an appropriate viscosity.

Pouring—The thickened liquid PU rubber 41 is poured into the mold cave 21 of the upper mold 20 (as shown in FIG. 2).

Applying a water-proof layer—The zipper 30 is disposed on the conveyor roller 50 and transmitted into the molds, such that the zipper teeth 31 fills into the groove 12 of the lower mold 10 and the zipper tapes 32 stay flat on the bottom of the positioning recession 11. The zipper tapes 32 go through the underside of the mole cave 21, the liquid PU rubber 41 in the mold cave 21 will infiltrate into the fabric of the zipper tapes 32 as desired. As a traction force generates between the liquid PU rubber 41 and the processing zipper tapes 32, the liquid PU rubber 41 will form a liquid wheel 42 (see FIG. 3), which will attach to and roll on the surface of the zipper 30. Furthermore, by way of a scraper portion 22 at the lower edge of the upper mold 20, the surplus liquid PU rubber 41 can be removed and those adhered to the tapes 32 of the zipper 30 would have an even thickness to form a water-proof layer 43 (as shown in FIG. 3). Being pressed by the liquid wheel 42 and the scraper portion 22, the liquid PU rubber 41 will infiltrate into the fabric of the tapes 32 of the zipper 30 and form a layer of even height on the surface of the tapes 32. In order to expedite drying the water-proof layer, a heating device 60 can be provided at the outlet end for drying purposes.

Figure 4:
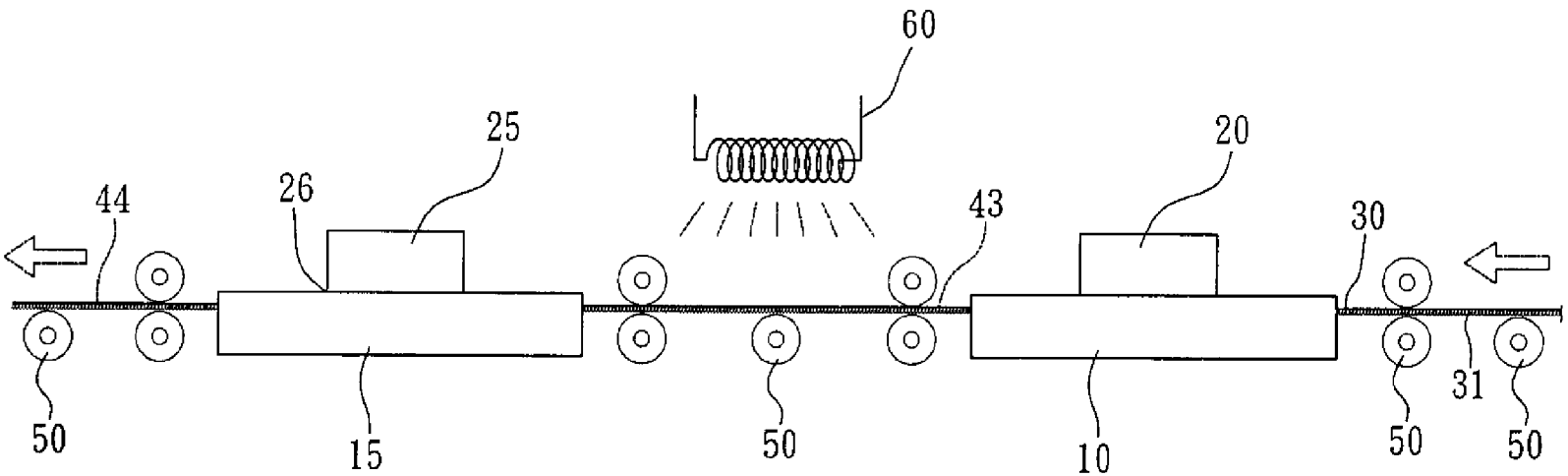
FIG. 4 shows the multi-process procedure according to the invention.
Figure 6:
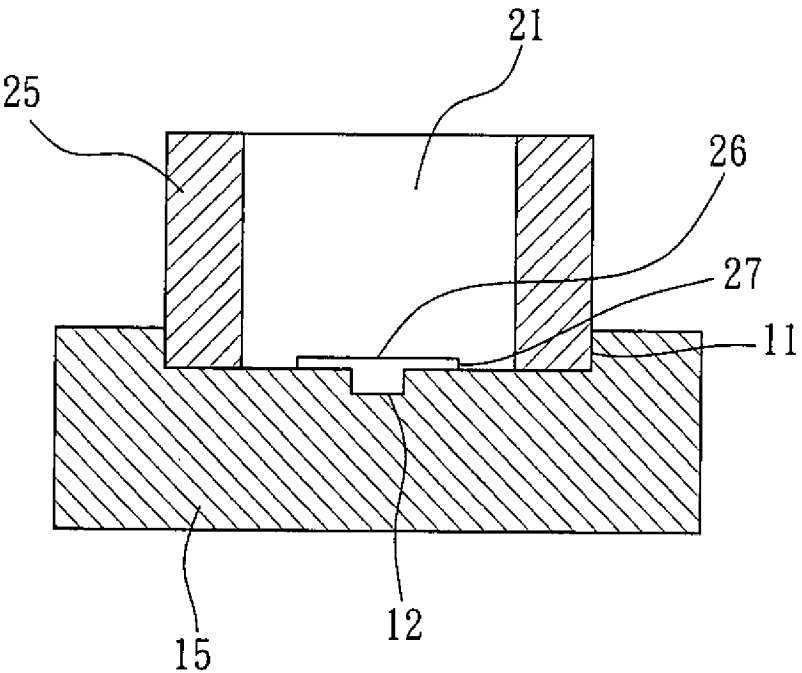
FIG. 6 is a cut-away view showing the supplementary molds of the invention.

Now refer to FIGS. 4 and 6, showing another embodiment of the invention, the zipper applied with a water-proof layer 43 can be baked by the heating device 60, such that the water-proof layer 43 will be instantly dried. After that, application of a second layer of water-proof 43 can be applied, including provision of a supplementary lower mold 15 and upper mold 25. Likewise, the supplementary lower mold 15 is provided with a positioning recession 11 and groove 12. The gap 27 at the lower edge of the supplementary upper mold 25 forms a supplementary scraper portion 26 (as shown in FIG. 6). After application of second water-proof film 44 to the zipper 30, the gap 27 of the supplementary scrapper portion 26 can allow the tapes 32 along with the applied water-proof film 43 to pass through. Therefore, when the zipper already coated with the water-proof film 43 is pulled through the supplementary upper and lower molds, the second water-proof film 44 will cover the original water-proof film 43 (as shown in FIG. 4). Accordingly, a water-proof zipper of an appropriate thickness can be accomplished.

Figure 5:
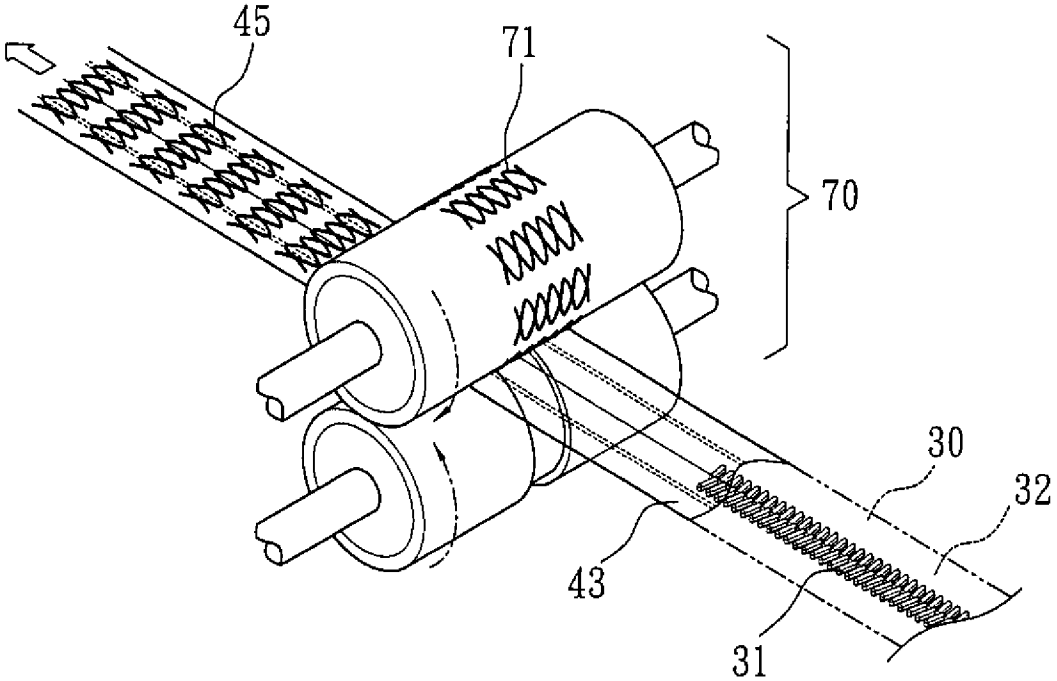
FIG. 5 shows the process of imprinting patterns on the zipper.

FIG. 5 shows a further embodiment of the invention which is provided with a patterning roller 70 so that the zipper 30 with the water-proof film 43 can be imprinted with a pattern 45 via the patterning roller 70. The patterning roller 70 is provided with notches 71 such that when the zipper 30 is pressed by the patterning roller 70, a pattern 45 can be imprinted on the water-proof layer 43 of the zipper 30, accomplishing a beautiful water-proof zipper.

Under the principle of the manufacture process, the pattern can be imprinted on the zipper via roller printing, mold pressing or spraying with colorants, which can be added with metal powder such as gold power and silver powder, etc. to increase the impressiveness of the product. Furthermore, after imprinting the pattern 45 on the surface of the water-proof zipper, an additional protective layer (not shown) can be applied to coat the colorants and/or metal power for the pattern, such that the patter would not be easily scratched.

Concluded above, the apparatus according to the present invention is mainly characterized by the scraper portion at the lower edge of the upper mold for obtaining squeezing effect to the applied liquid PU rubber, and infiltrating a water-proof material into the fabric of the zipper tapes according to the invention can lengthen the use life of the water-proof zipper and prevent the zipper from being easily bended and damaged. Although specific embodiments have been illustrated and described, it will be obvious to those skilled in the art that various modifications may be made without departing from what is intended to be limited solely by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An apparatus for manufacturing infiltrating water-proof material for a zipper comprising:

a lower mold provided with a longitudinal positioning recession for receiving zipper tape of said zipper and a longitudinal groove for receiving zipper teeth of said zipper, said longitudinal groove being arranged at a center of said longitudinal positioning recession;

an upper mold fitted in said longitudinal positioning recession thereby covering a top of said longitudinal groove, said upper mold having a mold cave in communication with said longitudinal positioning recession and said longitudinal groove, said upper mold having a bottom edge provided with a scraper portion adhering to a bottom surface of said longitudinal positioning recession;

a liquid PU rubber filled into said mold cave of said upper mold, said liquid PU rubber being formed by mixing a liquid PU rubber water-proof material with a thickening agent and a hardening agent to have a predetermined viscosity, said liquid PU rubber infiltrating into fabric of said zipper tape of said zipper through said mold cave of said upper mold and being pulled by a traction force generated between said liquid PU rubber and said zipper tape to form a liquid wheel which will attach to and roll on said zipper tape thereby providing a water-proof film on said zipper tape;

at least a conveyor roller for transmitting said zipper into said longitudinal positioning recession with said zipper teeth of said zipper filled into said longitudinal groove of said lower mold thereby moving said zipper under said upper mold; and a supplementary lower mold and a supplementary upper mold, said supplementary lower mold being provided with a positioning recession for receiving and a groove, said supplementary upper mold fitted in said positioning recession of said supplementary lower mold and having a lower edge which is provided with a gap forming a supplementary scarper portion, said supplementary upper mold having a mold cave in communication with said positioning recession and said groove of said supplementary lower mold.

* * * * *